US006437838B1

(12) United States Patent
Swank et al.

(10) Patent No.: US 6,437,838 B1
(45) Date of Patent: Aug. 20, 2002

(54) MOUNTING LUGS PROVIDING REDUCED MICROPHONIC INTERACTION

(75) Inventors: Harry Robert Swank, Lancaster, PA (US); Zygmunt Marian Andrevski, Princeton, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 0 days.

(21) Appl. No.: 09/772,402

(22) Filed: Jan. 30, 2001

(51) Int. Cl.[7] ..... H04H 5/64
(52) U.S. Cl. ..... 348/836
(58) Field of Search ..... 348/818, 821, 348/822, 825, 826, 836; 313/482; 220/2.1, 2.3

(56) References Cited

U.S. PATENT DOCUMENTS

| | | | | |
|---|---|---|---|---|
| 2,917,735 A | * 12/1959 | Travis et al. | ..... | 348/836 |
| 4,390,809 A | 6/1983 | Mitchell et al. | ..... | 313/482 |
| 5,053,880 A | * 10/1991 | Swank | ..... | 348/826 |
| 5,055,934 A | 10/1991 | Swank | ..... | 348/822 |

FOREIGN PATENT DOCUMENTS

| | | | | |
|---|---|---|---|---|
| JP | 5-182602 | * 7/1993 | ..... | H01J/29/87 |

* cited by examiner

*Primary Examiner*—Lanna Mai
*Assistant Examiner*—Jerry A. Anderson
(74) *Attorney, Agent, or Firm*—Joseph S. Tripoli; Dennis H. Irlbeck; Carlos M. Herrera

(57) ABSTRACT

A display apparatus 10 comprises at least one speaker 16 and a cathode-ray tube (CRT) 14 secured within an enclosure 12 to a plurality of mounting bosses 50. The cathode-ray tube 14 has an evacuated envelope 17 with a substantially rectangular-shaped faceplate panel 18 having four corners and a viewing portion 26 extending to a peripheral sidewall 28. The viewing portion 26 has a luminescent line screen 32 on the interior surface thereof The viewing portion 26 including two orthogonal axes, a major axis, X, parallel to a longer dimension of the viewing portion and a minor axis, Y, parallel to a smaller dimension of the viewing portion. The CRT 14 has therein an electron gun 38, capable of generating at least one electron beam, aligned along a central longitudinal axis, Z, of the CRT that is perpendicular to the major and minor axes. The CRT 14 also has a color selection electrode 36 in proximity to the interior surface of the viewing portion 26 of the faceplate panel 18. An implosion protection band 44 extends around the sidewall 28 of the faceplate panel 18. At least four mounting lugs 146, 246, 346, each having a base portion 148, 248, 348 and an attachment portion 150, 249–250, 350, with a mounting aperture 152, 251–252, 352, therethrough, cooperate with the implosion protection band 44 to facilitate securing the CRT 14 within the enclosure 12. The attachment portion 150, 249–250, 350, of each of the mounting lugs 146, 246, 346, is aligned along the central longitudinal axis, Z, of the CRT 14 and parallel to at least one of the two orthogonal axes, X, Y, to strengthen the attachment portion and reduce microphonics induced by the speaker 16.

4 Claims, 9 Drawing Sheets

MOUNTING LUGS PROVIDING REDUCED MICROPHONIC INTERACTION

The invention relates generally to structures for supporting a display apparatus, such as a color television picture tube, within an enclosure, such as a cabinet, having at least one speaker and, more particularly, to mounting lugs which provide greater support to the color television picture tube and a reduction in microphonics to certain of the components within the tube induced by the acoustical vibration of the speaker.

BACKGROUND OF THE INVENTION

A cathode ray tube (CRT), such as a color television picture tube, is evacuated to a very low pressure and accordingly is subject to the possibility of implosion due to the stresses produced by atmospheric pressure acting on all surfaces of the tube. This problem has been addressed in the art by providing the CRT with an implosion protection band, which circumscribes the faceplate of the tube and applies a compressive force thereto. Mounting lugs, either integral with, or attached to the implosion protection band are used to support the tube within the cabinet. Typically, the mounting lugs are positioned at the corners of the tube and have an attachment surface disposed perpendicular to the sidewall of the faceplate and aligned along the faceplate diagonals. Bolts, screws or equivalent hardware extend through openings in the mounting surfaces of the lugs to attach the tube to mounting bosses in the cabinet. This effectively couples the tube to the cabinet along the longitudinal, or Z-axis of the tube. In a cabinet having front-mounted speakers, the acoustical vibration of the speakers induces a maximum vibration to the tube and its internal components, especially the color selection electrode, in the Z-axis direction. Additionally, during transporting of the display apparatus, mishandling occasionally occurs, for example if the apparatus is dropped. If the drop occurs with the CRT in a "neck down" orientation, the mounting lugs may be bent resulting in a gap between the bezel of the enclosure and the tube. If conductive material is inadvertently inserted into this gap it is possible that electrical contact with portions of the tube that operate a high voltage could occur.

SUMMARY OF THE INVENTION

A display apparatus comprises at least one speaker and a cathoderay tube (CRT) secured within an enclosure to a plurality of mounting bosses. The cathode-ray tube has an evacuated envelope with a substantially rectangular-shaped faceplate panel having four corners and a viewing portion extending to a peripheral sidewall. The viewing portion has a luminescent line screen on the interior surface thereof. The viewing portion including two orthogonal axes, a major axis parallel to a longer dimension of the viewing portion and a minor axis parallel to a smaller dimension of the viewing portion. The CRT has therein an electron gun, capable of generating at least one electron beam, aligned along a central longitudinal axis of the CRT that is perpendicular to the major and minor axes. The CRT also has a color selection electrode in proximity to the interior surface of the viewing portion of the faceplate. An implosion protection band extends around the sidewall of the faceplate panel. At least four mounting lugs, each having a base portion and an attachment portion with a mounting aperture therethrough, cooperate with the implosion protection band to facilitate securing the CRT within the enclosure. The attachment portion of each of the mounting lugs is aligned along the central longitudinal axis of the tube and parallel to at least one of the two orthogonal axes to strengthen the attachment portion and reduce microphonics induced by the speaker.

DETAILED DESCRIPTION OF THE PREFERRED EMBODIMENTS

Figure 1:
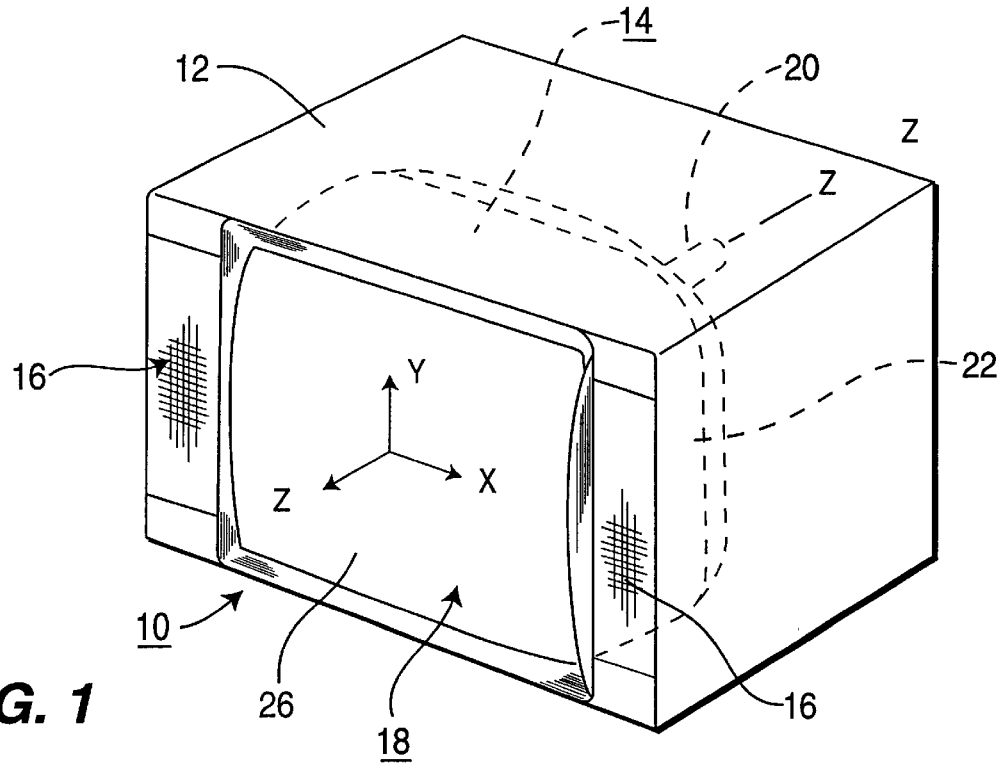
FIG. 1 is a perspective view of a display apparatus.
Figure 2:
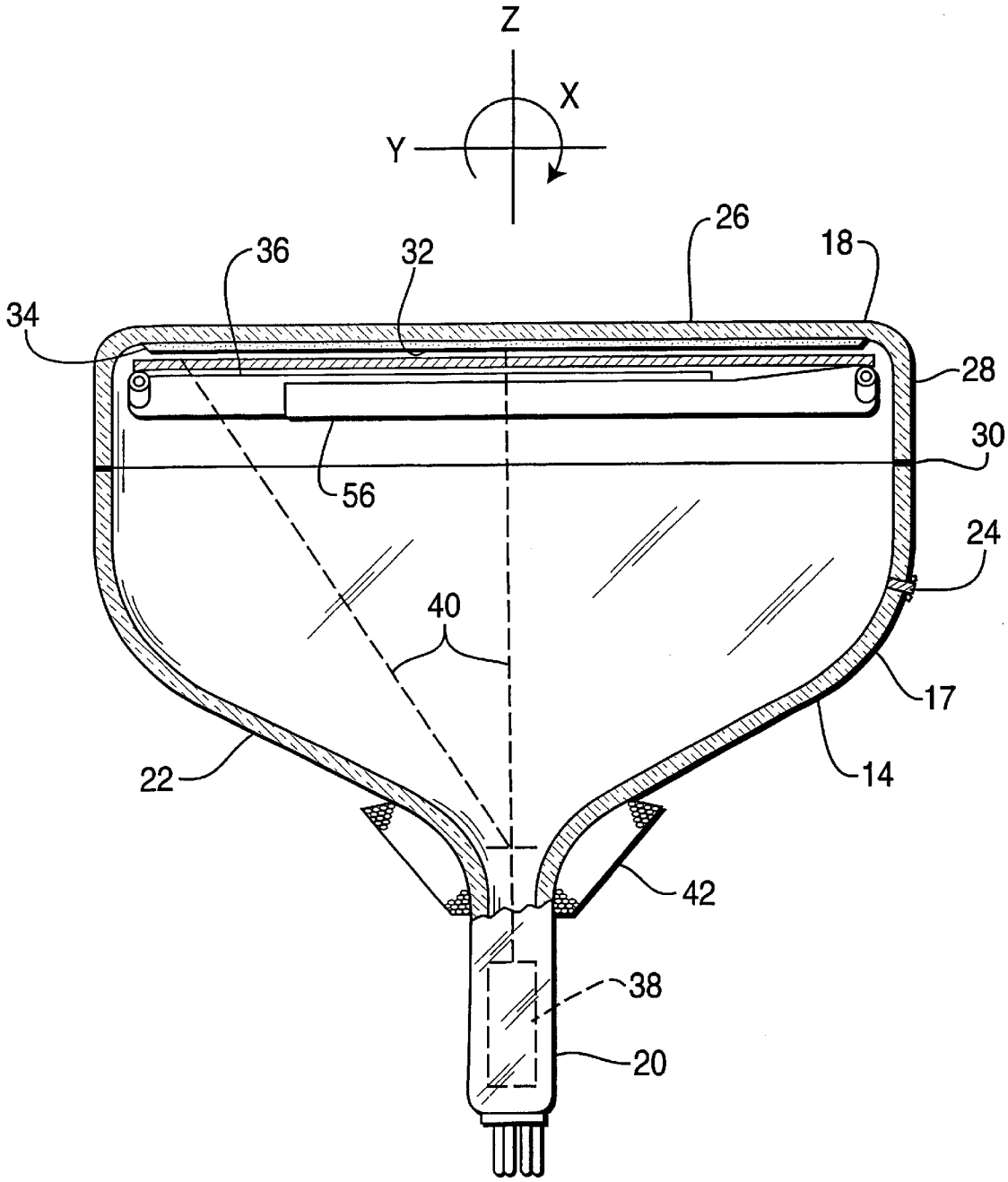
FIG. 2 is a plan view, partially in axial section, of a color CRT used in the display apparatus of FIG. 1.

FIG. 1 shows a display apparatus, such as a color television receiver, 10 comprising an enclosure 12 having therein a color CRT 14 and at least one audio speaker 16. As shown in FIG. 2, the color CRT 14 comprises an evacuated glass envelope 17 having a substantially rectangular faceplate panel 18 and a tubular neck 20 connected by a rectangular funnel 22. The funnel 22 has an internal conductive coating (not shown) that is in contact with and extends from an anode button 24 to the neck 20. The faceplate panel 18 has a viewing portion 26 and a peripheral sidewall 28 that is sealed to the funnel 22 by a glass frit 30. The viewing portion 26 of the faceplate panel 18 includes a major axis, X, parallel to a longer dimension of the viewing portion and a minor axis, Y, orthogonal to the major axis and parallel to a smaller dimension of the viewing portion of the faceplate panel. The CRT 14 further includes a central longitudinal axis, Z, which is mutually orthogonal to the major and minor axes, X and Y, respectively. A three-color luminescent phosphor screen 32 is carried on the inner surface of the viewing portion 26. The screen 32 is a line screen that includes a multiplicity of screen elements comprised of red-emitting, green-emitting and blue-emitting phosphor lines, R, G, and, respectively, arranged in triads, each triad including a phosphor line of each of the three colors. A thin conductive layer 34, preferably of aluminum, overlies the screen 32 and provides means for applying a potential thereto. A multi-apertured color selection electrode, such as a tension mask, 36 is removably mounted, by conventional means, within the faceplate panel 18, in predetermined spaced relation to the screen 32. An electron gun 38, shown schematically by the dashed lines in FIG. 2, is centrally mounted within the neck 20 to generate and direct three inline electron beams 40 along convergent paths through the tension mask 36 to the screen 32. The inline direction of the beams 40 is normal to the plane of the paper.

The CRT of FIG. 2 is used with an external magnetic deflection yoke 42 shown in the neighborhood of the funnel-to-neck junction. When activated, the yoke 42 subjects the three beams 40 to magnetic fields that cause the beams to scan a horizontal and vertical raster over the screen 32.

Figure 3:
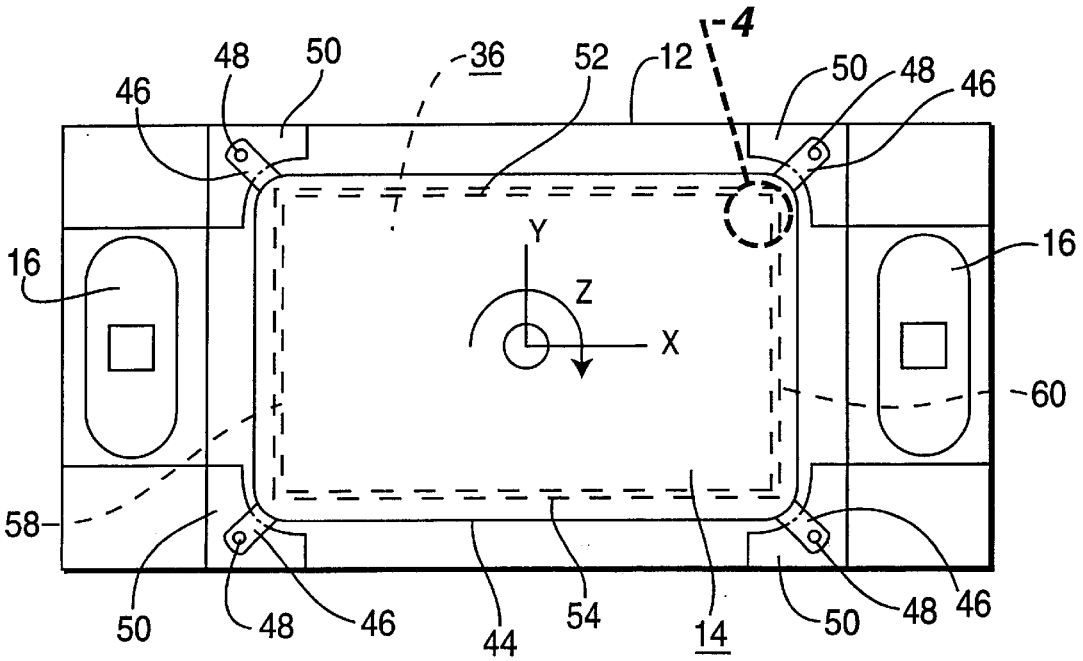
FIG. 3 PRIOR ART
FIG. 3 is a rear view of the display apparatus of FIG. 1 utilizing a prior art CRT mounting structure.
Figure 4:
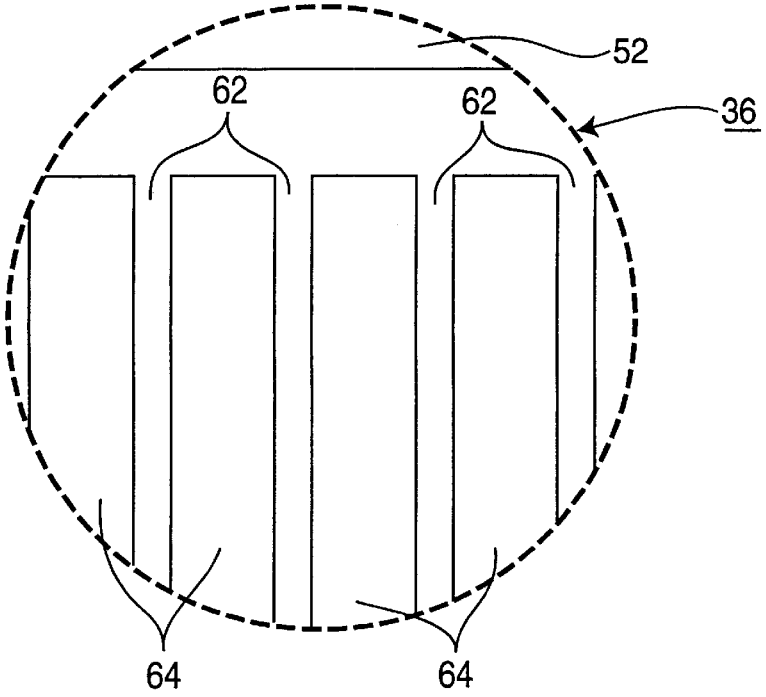
FIG. 4 is an enlarged section of a tension mask shown within circle 4 of FIG. 3.

An implosion protection band 44 surrounds at least a portion of the sidewall 28. The band 44 has at least four conventional mounting lugs 46 that are located at the corners of the band, as shown in FIG. 3. Each of the mounting lugs 46 includes a mounting aperture 48 therethrough, which is aligned along the longitudinal axis, Z, of the CRT 14. A screw or bolt, not shown, extend through each of the apertures 48 to affix the CRT 14 to retainers, not shown, aligned along the Z-axis of bosses 50 formed in the corners of the enclosure 12 The tension mask 36 includes two long sides 52, 54 attached to a frame 56, which is shown in FIG. 2, and two short sides 58, 60. The long sides 52, 54 of the mask parallel the major axis, X, of the CRT and the two short sides 58, 60 parallel the minor axis, Y, of the CRT. With reference to FIG. 4, the tension mask 36 includes a plurality of elongated metal strands 62 separated by substantially equal-spaced slots 64 that parallel the minor axis, Y, of the CRT and the phosphor lines, not shown, of the screen 32, as is known in the art. In an enclosure 12, having front-mounted speakers 16, the acoustical vibrations of the speakers may, under certain circumstances, induce microphonic vibrations to the metal strands 62 of the tension mask 36, which visibly distort the color fidelity of the image on the screen 32.

Figure 5:
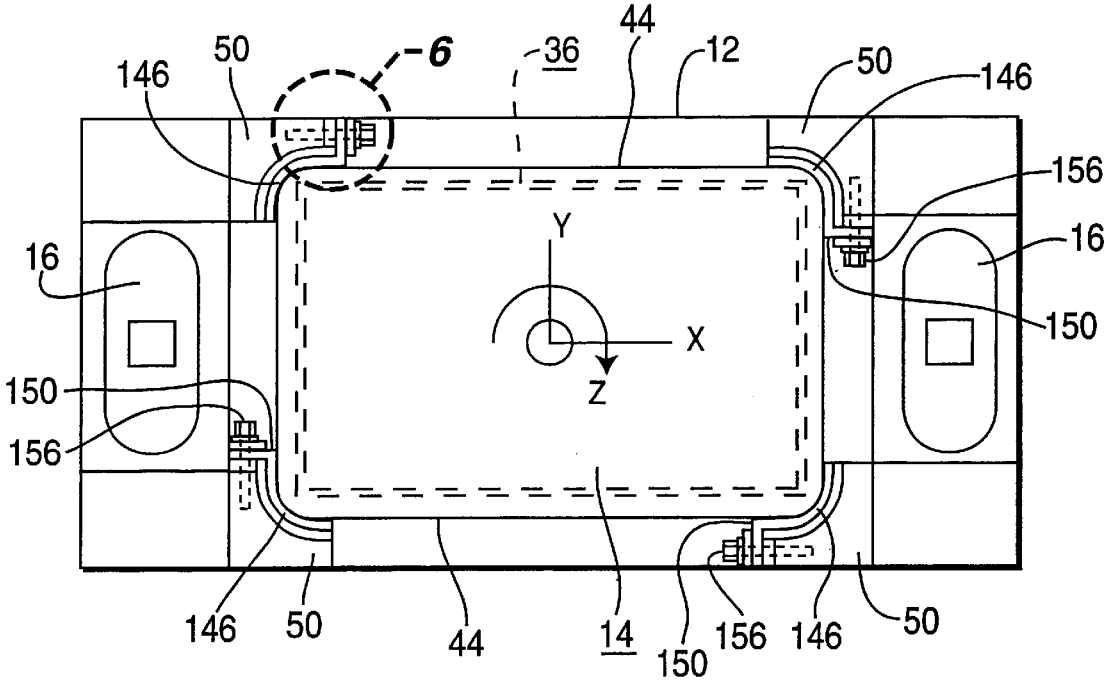
FIG. 5 is a rear view of the display apparatus utilizing a first embodiment of the novel CRT mounting structure.
Figure 6:
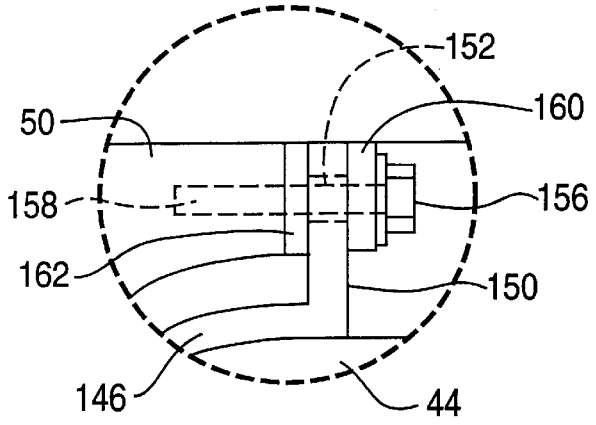
FIG. 6 is an enlarged view of a portion of the novel CRT mounting structure with the circle 6 of FIG. 5.
Figure 7:
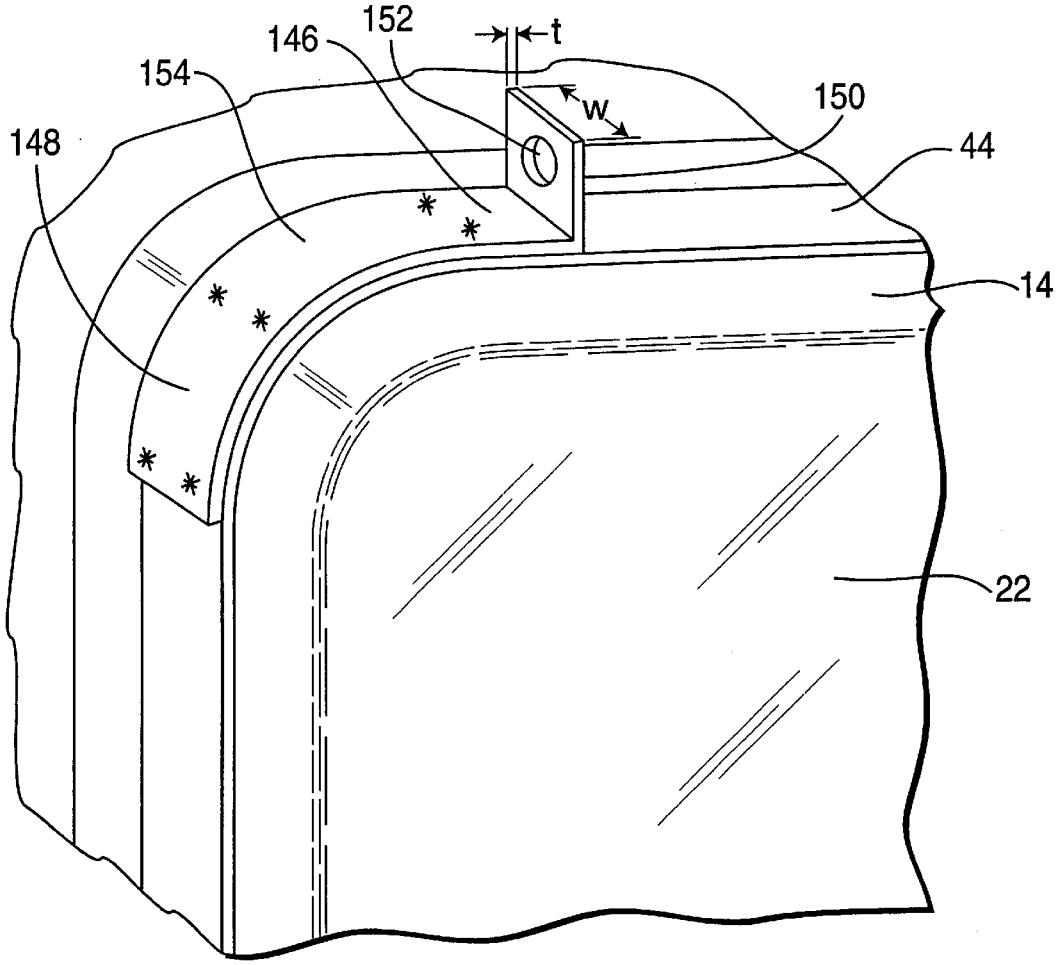
FIG. 7 is a rear view of a portion of the display apparatus utilizing the first embodiment of the novel CRT mounting structure.

FIGS. 5–7 show a first embodiment of the present invention that substantially reduces the microphonic vibrations of the metal strands 62, shown in FIG. 4, of the tension mask 36 due to the acoustical vibrations of the speakers 16. As shown in FIG. 5, the CRT 14 is secured within the enclosure 12 by means of a plurality of mounting lugs 146 that are attached in proximity to the corners of the implosion protection band 44. Each lug 146 includes a base portion 148 and an upstanding attachment portion 150 with an aperture 152 therethrough. The thickness, t, of the lug 146 is determined by the size and weight of the CRT 14 but is typically within the range of 2 to 3.2 mm. The width, W, of the upstanding portion 150 is typically 20–40 mm. The base portion 148 may include an arcuate shoulder portion 154 which extends around at least a portion of the corner of the CRT 14 and is attached to the implosion protection band 44, for example by welding. When attached to the band 44, the width of the upstanding portion 150 of the lug 146 is aligned along the Z-axis of the CRT and the aperture 152 is perpendicular thereto. As shown in FIGS. 5 and 6, a mounting bolt or screw 156 is disposed through the apertures 152 and secured within a retainer 158 formed in a side of the mounting boss 50. In the first embodiment, each lug 146 is attached to the right hand side of the mounting boss 50 in what is referred to hereinafter as a right-hand configuration. In this configuration the upstanding portions 150 of the upper left and lower right mounting lugs 146 are parallel to the Y-axis while the upstanding portions 150 of the upper right and the lower left mounting lugs 146 are parallel to the X-axis. Because the width of the upstanding portion 150 of the lug 146 is aligned along the Z-axis of the CRT 14 and has a significantly greater stiffness in the Z-axis, the acoustical vibrations of the speakers 16 cause substantially no motion of the CRT in the Z-axis direction and thereby isolate the strands 62 of the tension mask 36 from the acoustical vibrations of the speakers 16. To further aid in isolating the tension mask 36 from acoustical vibrations, a first isolator member 160 is disposed between the mounting bolt 156 and one surface of the upstanding portion 150 of the mounting lug 146. A second isolator member 162 is disposed between the opposite surface of the upstanding portion 150 and the boss 50. The isolator members 160 and 162 are formed of a suitable vibration or shock damping material, such as vinyl, thermoplastic rubber, or urethane. The isolator material may be tuned to the specific characteristics of the CRT by controlling both the stiffness and the damping characteristics of the material. Such materials are available from E-A-R Specialty Composites, Indianapolis, Ind., USA. Furthermore, in the event the display apparatus is dropped in a "neck down" orientation or otherwise mishandled, the upstanding portions 150 of the lugs 146, oriented in the right-handed configuration, are less likely to bend than the mounting lugs in the prior art configuration.

Figure 8:
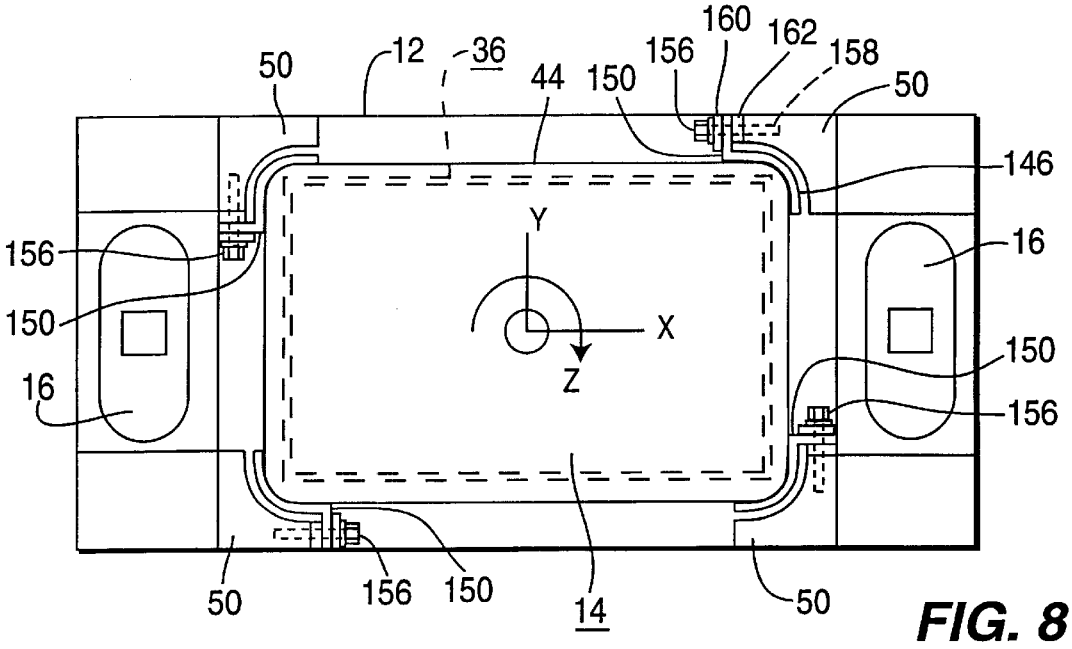
FIG. 8 is a rear view of the display apparatus utilizing a second embodiment of the novel CRT mounting structure.
Figure 9:
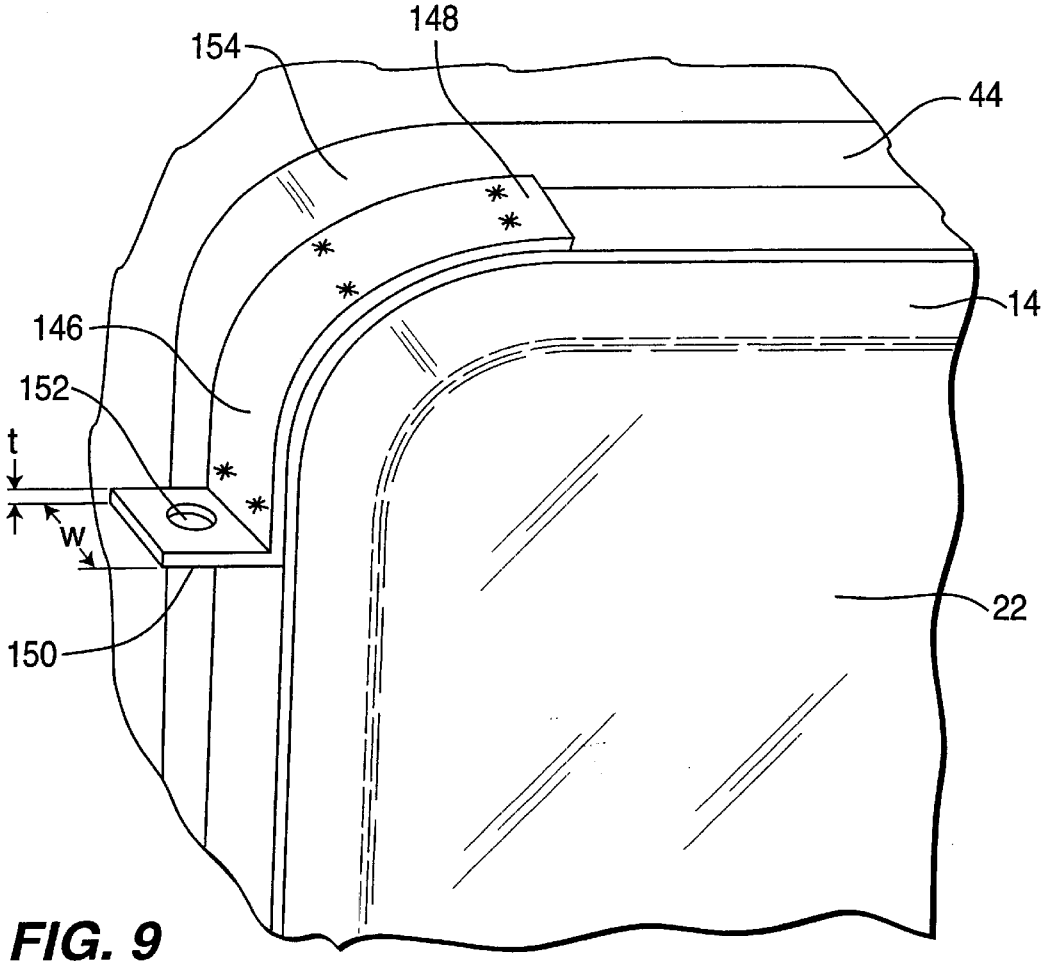
FIG. 9 is a rear view of a portion of the display apparatus utilizing the second embodiment of a novel CRT mounting structure.

A second embodiment of the invention is shown in FIGS. 8 and 9. In this embodiment, the mounting lugs 146, which are identical, in all respects, to those described in the first embodiment, also are attached in proximity to the corners of the implosion protection band 44. Each lug 146 is attached to the left-hand side of the mounting shown in FIG. 8, in what is referred to hereinafter as a left-hand configuration. In this configuration, the upstanding portions 150 of the upper right and lower left mounting lugs 146 are parallel to the Y-axis while the upstanding portions 150 of the upper left and the lower right mounting lugs 146 are parallel to the X-axis. Because the width of the upstanding portion 150 of the lug 146 is aligned along the Z-axis of the CRT 14 and has a width significantly greater than its thickness, the acoustical vibrations of the speakers 16 cause substantially no motion of the CRT in the Z-axis direction and thereby isolate the strands 62 of the tension mask 36 from the acoustical vibrations of the speakers 16. Furthermore, in the event the display apparatus is dropped in a "neck down" orientation or otherwise mishandled, the upstanding portions 150 of the lugs 146, oriented in the left-handed configuration, are less likely to bend that in the prior art configuration. The lugs 146 are attached to the bosses 50 in the manner described with respect to the first embodiment, utilizing bolts or screws 156 disposed through the apertures 152 and secured within the retainers 158 formed in the bosses 50. Preferably, isolator members 160 and 162 also are utilized is the manner described above.

Figure 10:
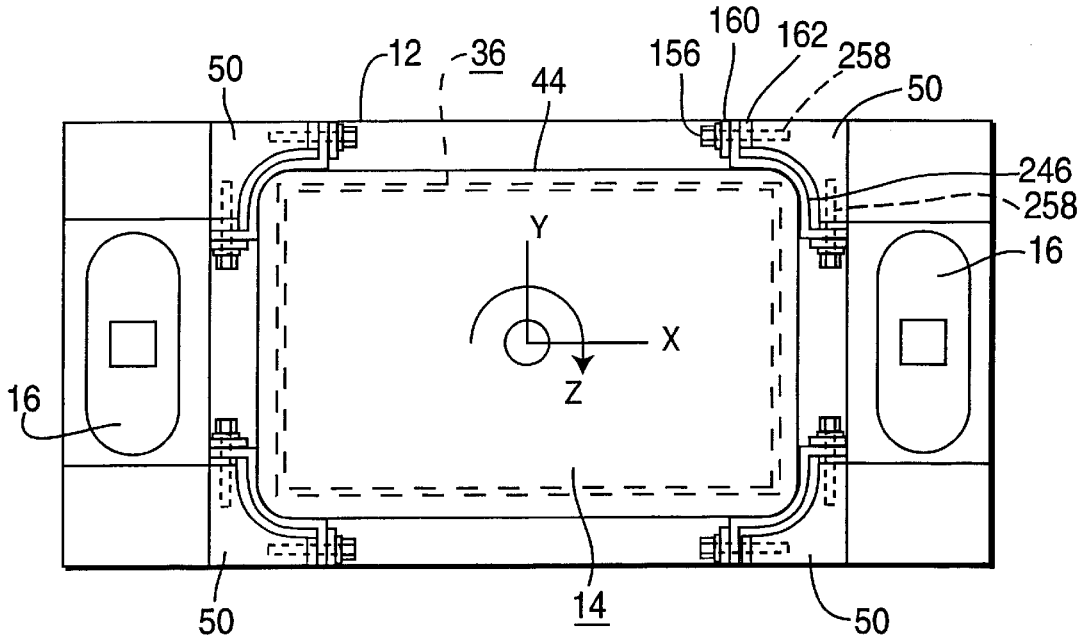
FIG. 10 is a rear view of a portion of the display apparatus utilizing a third embodiment of a novel CRT mounting structure.
Figure 11:
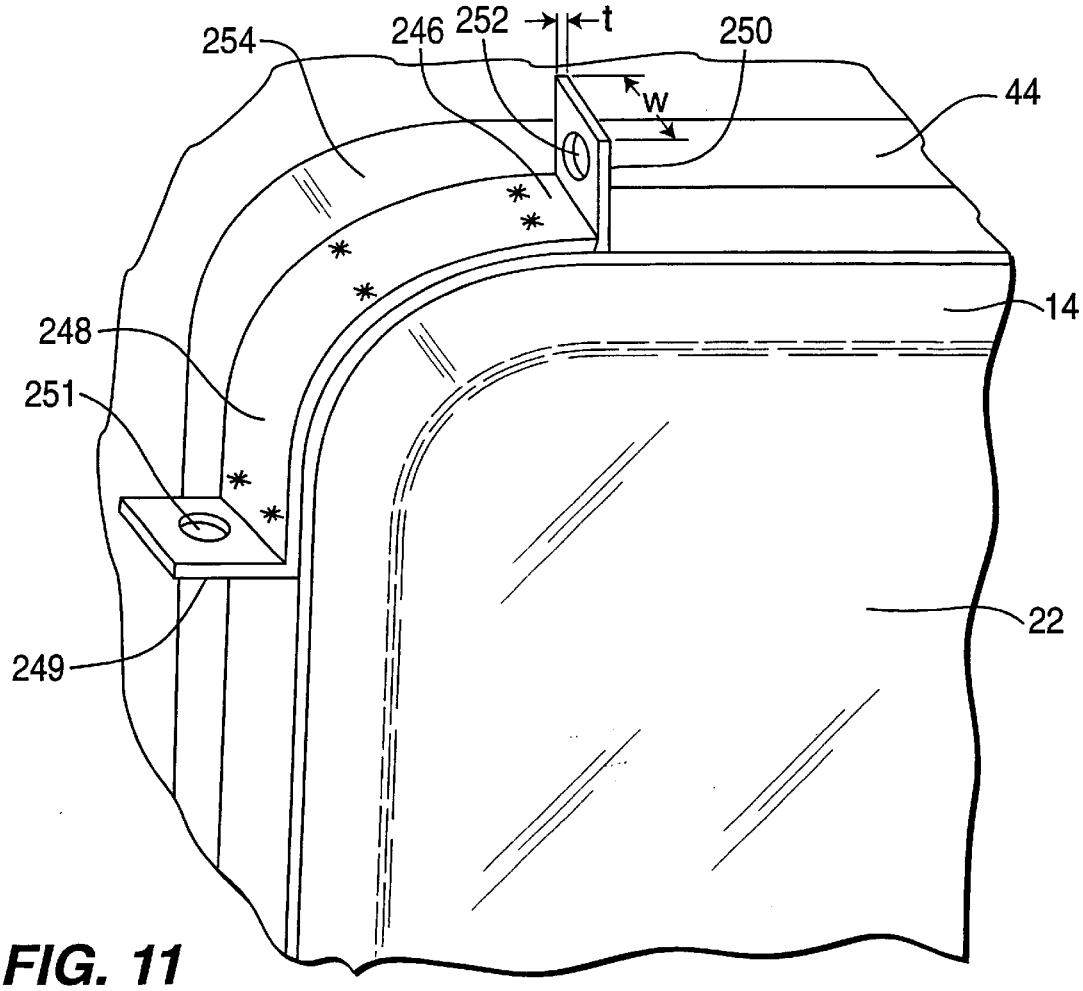
FIG. 11 is a rear view of a portion of the display apparatus utilizing the third embodiment of a novel CRT mounting structure.

A third embodiment of the invention is shown in FIGS. 10 and 11. In this embodiment, a mounting lug 246 is attached, for example by welding, to each of the corners of the implosion protection band 44. As shown in FIG.11, each mounting lug 246 includes a base portion 248 and two upstanding attachment portions 249 and 250 with apertures 251 and 252, respectively, therethrough. The thickness, t, of the lug 246 is determined by the size and weight of the CRT 14 but is typically within the range of 2 to 3.2 mm. The width, W, of the upstanding portions 249 and 250 is typically 20–40 mm. The base portion 248 includes an arcuate shoulder portion 254 that extends around the corner of the CRT 14 and is attached to the implosion protection band 44, for example by welding. When attached to the band 44, the upstanding portion 249 of the lug 246 is parallel to the major axis, X, of the CRT and the width of the upstanding portion 249 is aligned along the Z-axis of the CRT while the aperture 251 is perpendicular thereto. The upstanding portion 250 of the lug 246 is parallel to the minor axis, Y, of the CRT and the width of the upstanding portion 250 is aligned along the Z-axis of the CRT while the aperture 252 is perpendicular thereto. In the third embodiment, the upstanding portions 249 and 250 of each lug 246 are attached to opposite sides of the mounting boss 50 by means of bolts or screws 156 disposed through the apertures 251 and 252 and secured within the retainers formed in the boss. Preferably isolator members 160 and 162 are utilized as described above. Because the width of the upstanding portions 249 and 250 of the lug 246 are aligned along the Z-axis of the CRT 14 and have a width significantly greater than the thickness, the acoustical vibrations of the speakers 16 cause substantially no motion of the CRT in the Z-axis direction and thereby isolate the strands 62 of the tension mask 36 from the acoustical vibrations of the speakers 16. Furthermore, in the event the display apparatus is dropped in a "neck down" orientation. or otherwise mishandled, the upstanding portions 249 and 250 of the lugs 246, attached to both sides of the bosses 50, provides even greater strength than either of the first and second embodiments.

Figure 12:
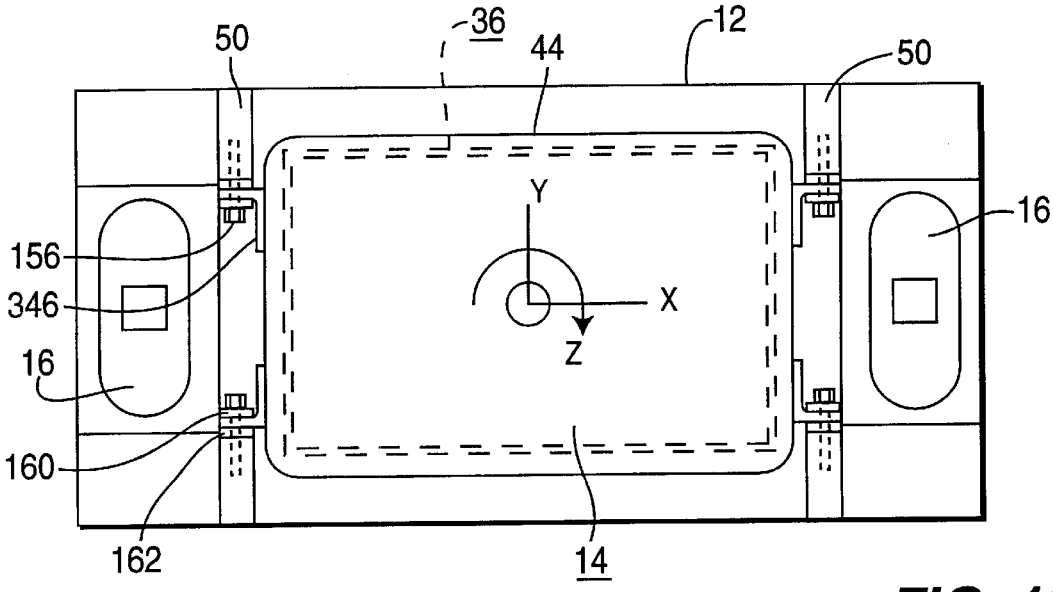
FIG. 12 is a rear view of the display apparatus utilizing a fourth embodiment of a novel CRT mounting structure.
Figure 13:
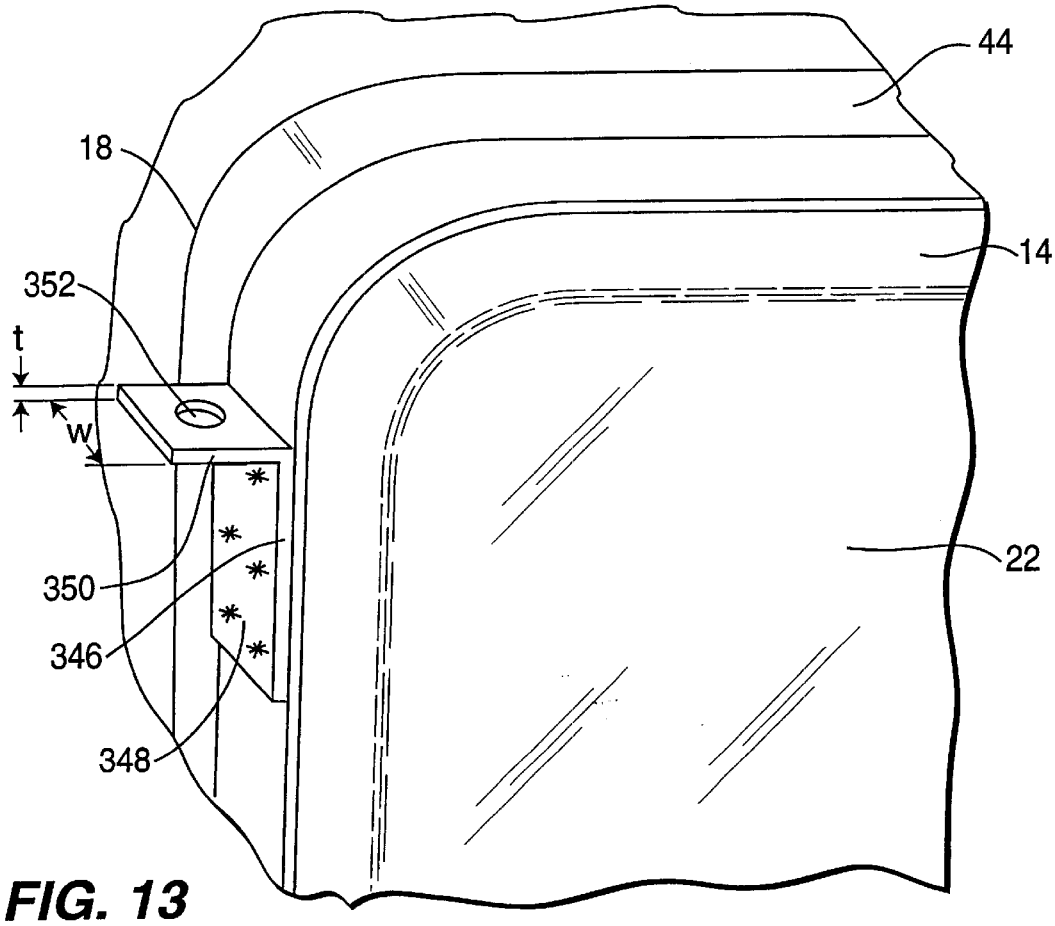
FIG. 13 is a rear view of a portion of the display apparatus utilizing the fourth embodiment of a novel CRT mounting structure.

A fourth embodiment of the invention is shown in FIGS. 12 and 13. In this embodiment, a mounting lug 346 is attached to the implosion protection band 44 along the smaller dimension of the faceplate panel 18, adjacent to each of the corners. Each mounting lug 346 includes a base portion 348 and an upright portion 350 with an aperture 352 therethrough. The thickness, t, of the lug 346 is determined by the size and weight of the CRT 14 but is typically within the range of 2 to 3.2 mm. The width, W, of the upstanding portion 350 is typically 20–40 mm. The width of the upstanding portion 350 of the lug 346 is aligned along the Z-axis of the CRT and the aperture 352 is perpendicular thereto. In the fourth embodiment, each lug 346 is faceplate panel 18 so that the upright portion 350 of each of the lugs 346 is parallel to the Y-axis of the faceplate panel 18. The lugs 346 are attached to the bosses 50 in the manner described with respect to the first embodiment, utilizing bolts or screws 156 disposed through the apertures 352 and secured within the retainers 158 formed in the bosses 50. Preferably, isolator members 160 and 162 also are utilized is the manner described above. Because the width of the upstanding portion 350 of the lug 346 is aligned along the Z-axis of the CRT 14 and has a width significantly greater than its thickness, the acoustical vibrations of the speakers 16 cause substantially no motion of the CRT in the Z-axis direction and thereby isolate the strands 62 of the tension mask 36.

Figure 14:
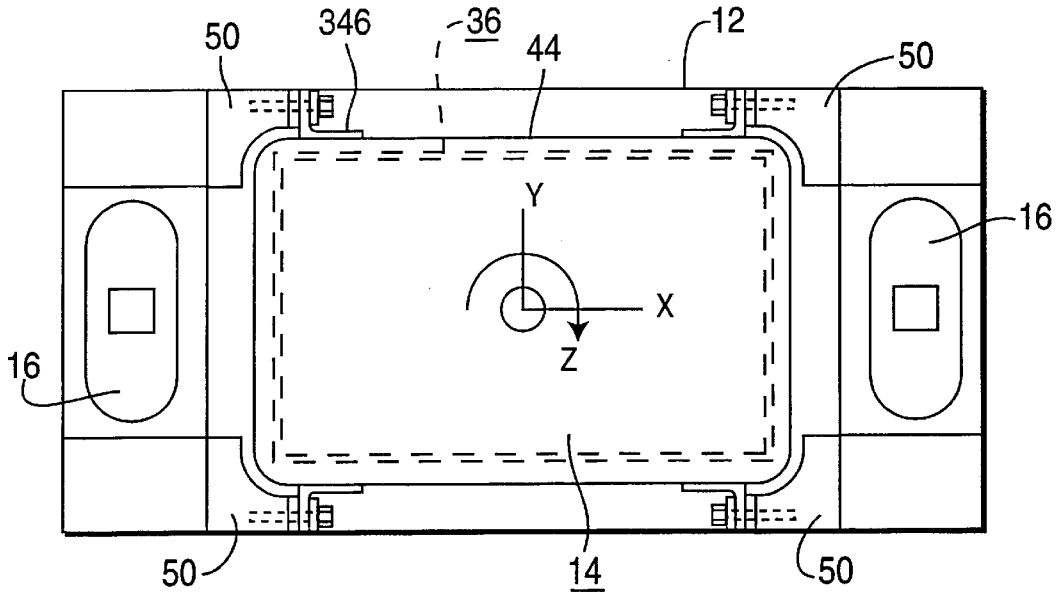
FIG. 14 is a rear view of the display apparatus utilizing a fifth embodiment of a novel CRT mounting structure.
Figure 15:
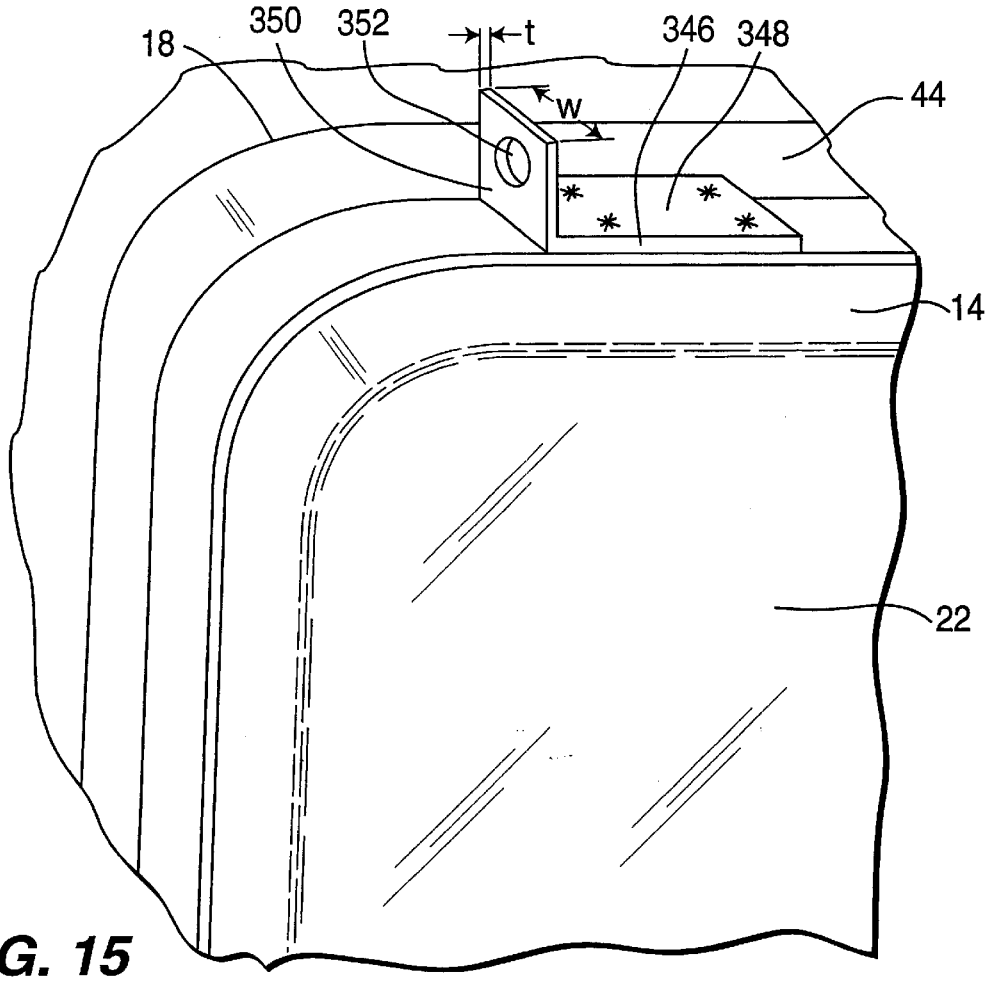
FIG. 15 is a rear view of a portion of the display apparatus utilizing the fifth embodiment of a novel CRT mounting structure.

A fifth embodiment of the invention, shown in FIGS. 14 and 15, is a variation of the fourth embodiment. In this embodiment, the mounting lugs 346, which are identical, in all respects to those described in the fourth embodiment, also are attached in proximity to the corners of the implosion protection band 44, but along the longer dimension of the faceplate 18. In the fifth embodiment, because each lug 346 is attached to the longer dimension of the implosion protection band, the upright portion 350 of each of the lugs 346 is parallel to the Y-axis of the faceplate panel 18. Because the width of the upstanding portion 350 of the lug 346 is aligned along the Z-axis of the CRT 14 and has a width significantly greater than its thickness, the acoustical vibrations of the speakers 16 cause substantially no motion of the CRT in the Z-axis direction and thereby isolate the strands 62 of the tension mask 36.

Figure 16:
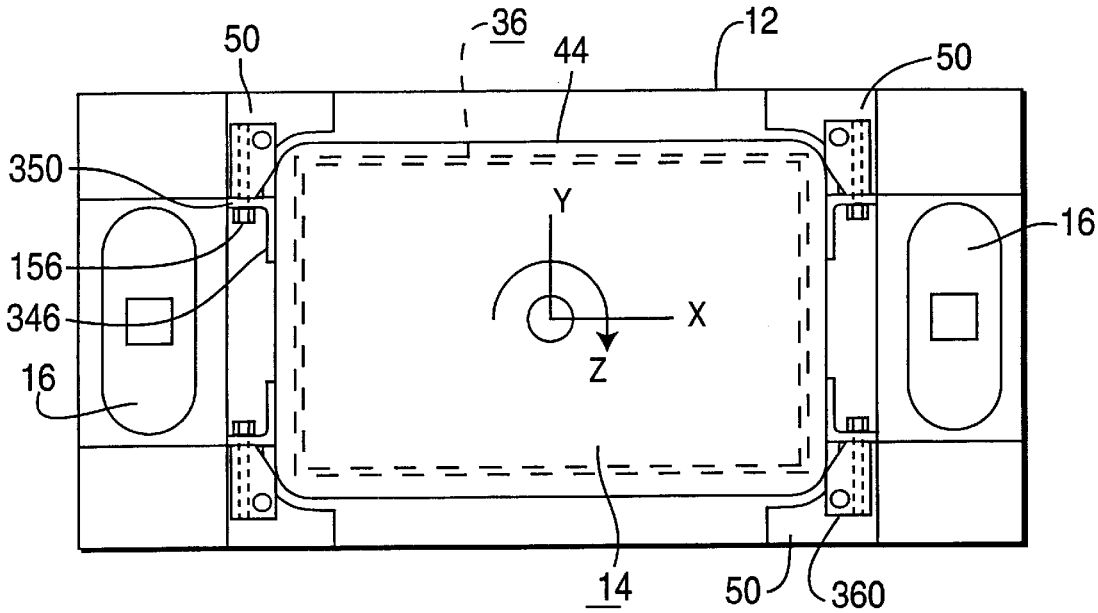
FIG. 16 is a rear view of the display apparatus utilizing a sixth embodiment of a novel CRT mounting structure.
Figure 17:
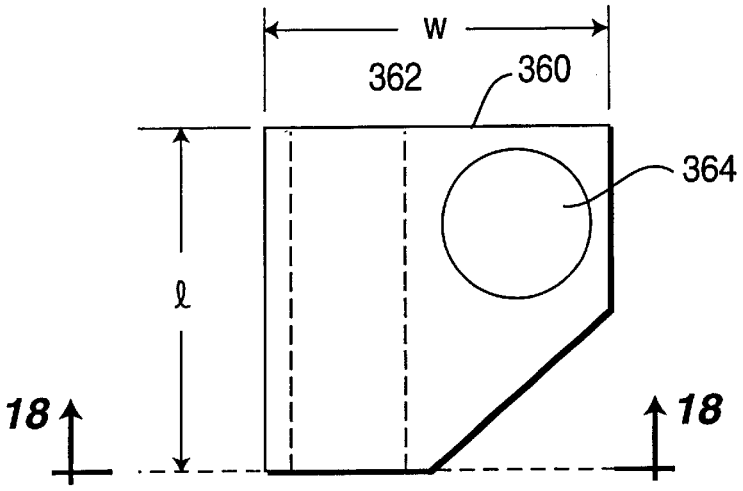
FIG. 17 is an enlarged plan view of a mounting adapter utilized in the sixth embodiment.
Figure 18:
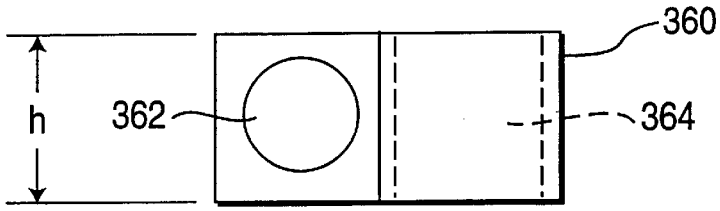
FIG. 18 is a bottom view along line 18—18 of FIG. 17.

A sixth embodiment of the invention is shown in FIGS. 16–18. In this embodiment, which is similar to the fourth embodiment, the mounting lug 346 is attached to the implosion protection band 44 along the smaller dimension of the faceplate panel of the CRT 14, adjacent to each of the corners so that the upright portion 350 of each of the lugs 346 is parallel to the Y-axis of the faceplate panel 18. Each of the lugs 346 is attached to a mounting adapter 360 by means of a bolt or screw 156 disposed through a first aperture 362 formed through the body of the mounting adapter 360. A second aperture 364, which is perpendicular to the first aperture 362, also extends through the body of the adapter 360.

A bolt or screw, not shown, is utilized to affix the mounting adapter 360 to a retainer, not shown, that is aligned along the Z-axis of each boss 50. This configuration permits the CRT 14 to be secured within an enclosure 12 that is identical to that of the prior art. However, in this embodiment, the mounting adapter 360 may be formed of metal or a suitable vibration or shock damping material, such as vinyl, thermoplastic rubber, or urethane. The material composition of the mounting adapter 360 may be tuned to the specific characteristics of the CRT by controlling both the stiffness and the damping characteristics thereof. Such materials are available from E-A-R Specialty Composites, Indianapolis, Ind., USA. In this example, the mounting adapter 360 has a length, l, of about 30 mm, a width, w, of about 30 mm, at its widest part, and a height, h, of about 16 mm. The corner of the mounting adapter 360 is truncated because of the cost of the damping materials. Because the width of the upstanding portion 350 of the mounting lug 346 is aligned along the Z-axis of the CRT 14 and has a width significantly greater than its thickness, the acoustical vibrations of the speakers 16 cause substantially no motion of the CRT in the Z-axis direction and thereby isolate the strands 62 of the tension mask 36.

While the sixth embodiment shows the mounting lugs 346 attached to the implosion protection band 44 along its smaller dimension, it is within the scope of the invention to attach the lugs 346 along the larger dimension of the band 44, as shown in FIG. 14, and then attach the mounting adapters 360 thereto in order to secure the CRT 14 to the retainers formed along the Z-axis of the bosses 50.

What is claimed is:

1. A display apparatus comprising a cathode-ray tube secured within an enclosure to a plurality of mounting bosses, said enclosure further including at least one speaker, said cathode-ray tube having an envelope with a substantially rectangularly-shaped faceplate panel having corners and including a viewing portion extending to a peripheral sidewall, said viewing portion having a luminescent screen on an interior surface thereof, said viewing portion including two orthogonal axes, a major axis parallel to a longer dimension of said viewing portion and a minor axis parallel to a smaller dimension of said viewing portion, said cathode-ray tube having therein an electron gun for generating at least one electron beam along a central longitudinal axis which is perpendicular to said major and minor axes, said cathode-ray tube having a color selection electrode in proximity to said interior surface of said viewing portion, and implosion protection band extending around said sidewall of said faceplate panel and a plurality of mounting lugs each having a base portion and an attachment portion with a mounting aperture therethrough, said mounting lugs cooperating with said implosion protection band to secure said cathode-ray tube within said enclosure wherein said attachment portion of said mounting lugs are secured to said bosses and oriented in a left-hand configuration, said attachment portion of each of said mounting lugs having a width and a thickness wherein the width is greater than the thickness thereof, said attachment portion being parallel to at least one of said major and minor axis, the width of said attachment portion being aligned along said central longitudinal axis to strengthen said attachment portion and reduce microphonics induced by said speaker.

2. A display apparatus comprising a cathode-ray tube secured within an enclosure to a plurality of mounting bosses, said enclosure further including at least one speaker, said cathode-ray tube having an envelope with a substantially rectangularly-shaped faceplate panel having corners and including a viewing portion extending to a peripheral sidewall, said viewing portion having a luminescent screen on an interior surface thereof, said viewing portion including two orthogonal axes, a major axis parallel to a longer dimension of said viewing portion and a minor axis parallel to a smaller dimension of said viewing portion, said cathode-ray tube having therein an electron gun for generating at least one electron beam along a central longitudinal axis which is perpendicular to said major and minor axes, said cathoderay tube having a color selection electrode in proximity to said interior surface of said viewing portion, and implosion protection band extending around said sidewall of said faceplate panel and a plurality of mounting lugs each having a base portion and two attachment portions one attachment portion being aligned parallel to said major axis and the other attachment portion being aligned parallel to said minor axis with a mounting aperture therethrough, said mounting lugs cooperating with said implosion protection band to secure said cathode-ray tube within said enclosure, said attachment portion of each of said mounting lugs having a width and a thickness wherein the width is greater than the thickness thereof, the width of said attachment portion being aligned along said central longitudinal axis to strengthen said attachment portion and reduce microphonics induced by said speaker.

3. A display apparatus comprising a cathode-ray tube secured within an enclosure to a plurality of mounting bosses, said enclosure further including at least one speaker, said cathode-ray tube having an envelope with a substantially rectangularly-shaped faceplate panel having corners and including a viewing portion extending to a peripheral sidewall, said viewing portion having a luminescent screen on an interior surface thereof, said viewing portion including two orthogonal axes, a major axis parallel to a longer dimension of said viewing portion and a minor axis parallel to a smaller dimension of said viewing portion, said cathode-ray tube having therein an electron gun for generating at least one electron beam along a central longitudinal axis which is perpendicular to said major and minor axes, said cathode-ray tube having a color selection electrode in proximity to said interior surface of said viewing portion, and implosion protection band extending around said sidewall of said faceplate panel and a plurality of mounting lugs each having a base portion and an attachment portion with a mounting aperture therethrough, said mounting lugs cooperating with said implosion protection band to secure said cathode-ray tube within said enclosure wherein said attachment portion of said mounting lugs are secured to said bosses and oriented in a right-hand configuration, said attachment portion of each of said mounting lugs having a width and a thickness wherein the width is greater than the thickness thereof, said attachment portion being parallel to at least one of said major and minor axis, the width of said attachment portion being aligned along said central longitudinal axis to strengthen said attachment portion and reduce microphonics induced by said speaker.

4. The display apparatus as described in claim 2, 1 or 3, wherein a mounting adapter is attached between each of said attachment portions of said mounting lugs and said bosses.

* * * * *